United States Patent [19]

Eriksson

[11] 4,019,936

[45] Apr. 26, 1977

[54] METHOD FOR FLOORING ON A CLOSED UNDERLAYER

[75] Inventor: Erik Gustav Lennart Eriksson, Valberg, Sweden

[73] Assignee: AB Karlstadplattan, Valberg, Sweden

[22] Filed: May 5, 1975

[21] Appl. No.: 574,699

Related U.S. Application Data

[63] Continuation-in-part of Ser. No. 478,952, June 13, 1974, Pat. No. 3,959,195, which is a continuation-in-part of Ser. No. 136,774, April 23, 1971, abandoned.

[30] Foreign Application Priority Data

May 15, 1974 Sweden ..... 7406503

[52] U.S. Cl. ..... 156/71; 52/741; 156/254; 156/62.2; 264/123; 264/128; 428/326

[51] Int. Cl.[2] ..... E04B 5/00

[58] Field of Search ..... 156/71, 254, 62.2; 264/124, 109, 128, 123; 404/2.7; 52/365, 741; 428/326

[56] References Cited

UNITED STATES PATENTS

| | | | |
|---|---|---|---|
| 42,589 | 5/1864 | Meyers | 404/27 |
| 311,390 | 1/1885 | Thompson | 156/71 |
| 2,877,135 | 3/1959 | Schwarzwalden et al. | 156/71 |
| 3,031,325 | 4/1962 | Roberts | 428/326 |
| 3,224,925 | 12/1965 | Brandts et al. | 264/124 |
| 3,252,815 | 5/1966 | Glab | 264/124 |
| 3,305,499 | 2/1967 | Berans | 264/124 |
| R17,010 | 6/1928 | Boelkow et al. | 404/27 |

FOREIGN PATENTS OR APPLICATIONS

| | | | |
|---|---|---|---|
| 721,650 | 11/1952 | United Kingdom | 404/27 |

*Primary Examiner*—Edward G. Whitby

[57] ABSTRACT

Method for laying flooring on a solid sub-floor comprising the step of coating the sub-floor with a loose intermediate layer, screeding and thereafter covering the intermediate layer with a pressure distributing layer of semi rigid or rigid plates, whereby the intermediate layer consists of sawdust which has been sifted in order to remove particles having a size exceeding 5 mm and which have improved slender values by having been cut and split substantially along the grain, the sawdust being spread on the sub-floor, screeded to a thickness of 5–25 mm, and covered with the plate material which may be coated with an outer or wearing layer.

9 Claims, No Drawings

METHOD FOR FLOORING ON A CLOSED UNDERLAYER

This application is a continuation-in-part of U.S. application Ser. No. 478,952 filed June 13, 1974, now U.S. Pat. No. 3,959,195, which itself was a continuation-in-part of U.S. Ser. No. 136,774 filed Apr. 23, 1971, now abandoned.

The invention relates to a method for laying flooring on a solid sub-floor, the sub-floor being coated with a loose intermediate layer, which is screeded and thereafter covered with a pressure distributing layer of half rigid or rigid plates. Such sub-floors can consist of cast concrete framed floor, the existing original floor or the like. Preferably the invention is used with a ground which is somewhat uneven and has to be screeded before the same can be covered with an outer layer. In this connection it is known in prior art to coat an underlayer with a smoothing intermediate layer which is covered with a solid outer layer (DAS No. 1.149.156).

The object of the present invention is to propose a method of the above mentioned kind which is easy and inexpensive to apply and provides an intermediate layer which under persisting load conditions is not subjected to so called cold flow. Another object of the invention is to provide a certain insulating effect against heat and step noise.

These objects are achieved with the invention mainly in that the intermediate layer consists of sawdust, which before spreading is sifted in order to remove too large and too long particles, i.e. having a size greater than the depth to which the sawdust is to be spread the sifted sawdust before being spread has obtained improved slender values by cutting and splitting the sawdust particles substantially along the grain, and the thus pretreated sawdust material is spread on the sub-floor and screeded to a thickness of 5–25 mm, preferably 10–15 mm, whereafter the plate material is applied upon the thus screeded sawdust layer, whereafter the plate material can be coated with a wearing layer etc.

The sawdust being used as intermediate layer is a cheap raw material of low volumetric weight, having sound dampening and bad heat conductive qualities. Another advantage is that the board particles will be lying in all possible directions, i.e. among other with their length parallel or perpendicular to the underlayer or in many other positions. Hence, the sawdust obtains a very good bearing capacity, the particles are "felted" together and the irregularities of the ground are compensated. Pointlike bearing pressures which may occur are distributed on a larger surface owing to the half rigid or rigid plate material.

The cutting or the splitting of the particles becomes particularly effective, when preferably coarse grained particles are cut, respectively split. The experience has proved that by such splitting or cutting the sawdust material becomes very suitable for the purpose in question. Owing to the improved slender value a better "felting" of the sawdust particles is obtained, which in turn improves the bearing qualities and the resilience of the floor.

According to other embodiments of the invention the sawdust before being spread is treated with a binder, preferably resins which harden or bind slowly at room temperature, i.e. ca 15°–20° C. These resin additives further increase the bearing capacity of the sawdust layer.

According to another embodiment of the invention the hardening of the thus treated sawdust can be accelerated or initiated by adding a hardener, a catalyzer or an accelerator. This allows the floor to be subjected to full load already after a shorter period of time. The adding of said hardening, catalyzer or accelerator is suitably carried out in liquid or gaseous form, as known in prior art.

Practical experiments have shown that floors which have been laid according to the invention involve low flooring and raw material costs but nevertheless provide good bearing without any appreciable sinkings at heavier loaded places.

The invention relates also to a sawdust material to be used in the method according to the invention.

The invention will now be described, by way of an example, with reference to one embodiment of the same.

The sawdust is sifted in order to remove too long and too coarse particles as determined by the depth of the sawdust layer to be employed, such as saw waste, splinters, pieces of bark etc. The thus sifted sawdust is sieved into two or more fractions having different grain size, at least the coarsest being put in a splitting device of a kind known per se, in which the sawdust particles are split essentially along the grain of the sawdust and restored to the fractioning device. Other fractions are fed separately or as a whole to a sizing device, a somewhat smaller binding quantity being needed in the first case. The sawdust is treated in the sizing device with suitable binders, preferably resins which harden or bind at room temperature.

The thus pretreated sawdust material, which may be mixed up to the same quantity with another suitable material, as for example shavings, cuttings, screenings from splintered paperwood for cellulose manufacturing, grindings and mechanical woodpulp dust from the furniture industry and the particle boards factories, is spread out on cast concrete framed floor and screeded to a thickness averaging to 10–15 mm. Thereafter the excess material is removed. The thus screeded sawdust layer is covered with a half rigid to rigid plate material, for instance particle boards, the thickness of which depends on the expected loading and the thickness of the underlaying intermediate layer, the fundamental rule being that thicker intermediate layers and heavier loads require thicker plate material. If the plate material consists of particle boards, it is advantageous to apply a wearing layer on the plate material either by painting or, for instance, covering with plastic plates, linoleum or another flooring material. The thickness of the semi-rigid or rigid plate material is advantageously 2–25 mm preferably 6–12 mm.

Before laying the half rigid or rigid plate material and when the sawdust is sized with suitable resins, it might be necessary to add hardeners, a catalyzer or an accelerator to speed up the hardening. Said additives can suitably be atomized or sprayed etc. on the sawdust layer.

Another possibility is to do without binders, whereby the stability in storage of the chips before spreading out becomes practically unlimited. This advantage, however, can also be obtained by applying the following procedure:

The sawdust from the sawmill is sifted, fractioned and split as above, whereafter the material without binding additives is distributed and possibly stored before use. The spreading and the screeding to the desired thickness is carried out as described above. Only thereafter binders and hardeners and possibly also accelerators are sprayed, sprinkled or squirted on the screeded sawdust layer, whereafter particle boards or other half rigid or rigid plate material is put on, whereafter in principle the floor is ready for use.

Hardening can also be added in gaseous form, for instance ammoniacal gas or sulfur dioxide. Hereby it is suitable to first lay out the plate material on the screeded sawdust layer, whereafter the hardener is added in gaseous form through openings in the plate material, which thereafter are closed again.

Practical tests have shown that floors laid according to the invention involve cost savings and good step noise isolation for the rooms underneath, whereas the sawdust layer simultaneously increases the heat isolating capacity of the floor and grinding the concrete floor etc. is not any more necessary.

Althouth the invention has been described with reference to one embodiment of the same it can be arbitrarily varied within the scope of the appending claims.

What is claimed is:

1. A method for laying flooring on a solid sub-floor, comprising the steps of applying to the sub-floor a layer consisting substantially of sawdust fractions of predetermined particle size, said sawdust fractions comprising coarse and fine fractions, the coarse fractions of which are sifted from the fine fractions and split substantially along the grain thereof to provide particles of sawdust of increased length to width ratio, spreading the sawdust layer on said sub-floor and screeding it with particles of sawdust in said fractions in random orientation relative to said sub-floor to form felted particles to a substantially uniform depth of from 5 to 25 mm, and applying at least one semi to fully rigid plate of predetermined thickness onto said sawdust treated during one of the recited steps of the process with an agent which hardens and binds the sawdust particles, the thickness of the plate being a direct function of the expected load upon and the thickness of the sawdust layer.

2. A method for laying flooring according to claim 1, wherein the plate material is selected from particle boards, wooden boards, plywood boards and fiber boards having a thickness of from 2–25 mm.

3. A method according to claim 1, wherein after having been sifted the sawdust is divided into at least two or more differently grained fractions and that the coarsest fraction is fed to a device for splitting substantially along the grain of the sawdust.

4. A method according to claim 1, wherein the sawdust before being spread is treated with said hardening agent which hardens at room temperature.

5. A method according to claim 4, wherein after the coarse fractions are sifted from said fine fractions and split, each fraction is then treated with said hardening agent.

6. A method according to claim 1, wherein the sawdust is treated with said hardening agent only after having been spread out and screeded, said sawdust being treated with said hardening agent by spraying thereof onto the sawdust layer.

7. A method according to claim 1, wherein a finishing layer is placed over said plates.

8. A method according to claim 1, wherein said sawdust is spread and screeded to a substantially uniform depth of from 10–15 mm.

9. A method according to claim 1, wherein the particles oriented perpendicularly to the plane of the sub-floor are no greater than 5 mm.

* * * * *